US009469386B2

(12) United States Patent
Hastilow et al.

(10) Patent No.: US 9,469,386 B2
(45) Date of Patent: Oct. 18, 2016

(54) DEVICE FOR COUPLING OF KITE LINES

(75) Inventors: David Hastilow, Hong Kong (CN); Patrick Goodman, Miua Li (CN)

(73) Assignee: NEIL PRYDE LIMITED, New Territories, Hong Kong (KR)

( * ) Notice: Subject to any disclaimer, the term of this patent is extended or adjusted under 35 U.S.C. 154(b) by 0 days.

(21) Appl. No.: 13/480,804

(22) Filed: May 25, 2012

(65) Prior Publication Data

US 2013/0048791 A1 Feb. 28, 2013

(30) Foreign Application Priority Data

May 25, 2011 (HK) ..... 11105222

(51) Int. Cl.
*B63B 35/79* (2006.01)

(52) U.S. Cl.
CPC ..... *B63B 35/7979* (2013.01)

(58) Field of Classification Search
CPC ..... B64B 35/7979
USPC ..... 244/153 R, 155 A
See application file for complete search history.

(56) References Cited

U.S. PATENT DOCUMENTS

| | | | | |
|---|---|---|---|---|
| 3,467,046 | A | 9/1969 | Welton | |
| 3,540,083 | A | 11/1970 | O'Connor | |
| 4,127,247 | A | 11/1978 | Strasilla | |
| 5,134,951 | A | 8/1992 | Nishimura | |
| 6,273,369 | B1 | 8/2001 | Nishimura et al. | |
| 6,513,759 | B2 | 2/2003 | Starbuck | |
| 6,581,879 | B2 * | 6/2003 | Bellacera | 244/155 A |
| 6,691,954 | B1 | 2/2004 | Harrington et al. | |
| 6,830,220 | B2 * | 12/2004 | Runyan | 244/155 A |
| 6,869,047 | B2 | 3/2005 | Pouchkarev | |
| 6,988,694 | B2 | 1/2006 | Barrs et al. | |
| 7,036,771 | B1 * | 5/2006 | Pouchkarev | 244/155 A |
| 7,575,198 | B2 * | 8/2009 | Hardham et al. | 244/155 A |
| 7,581,701 | B2 * | 9/2009 | Logosz et al. | 244/155 A |
| 7,621,485 | B2 * | 11/2009 | Logosz et al. | 244/155 A |
| 8,398,030 | B2 * | 3/2013 | Lawson | 244/155 A |
| 8,459,595 | B2 * | 6/2013 | Logosz et al. | 244/155 A |
| 2004/0004160 | A1 * | 1/2004 | Pouchkarev | 244/146 |
| 2005/0133669 | A1 * | 6/2005 | Royannais et al. | 244/155 A |
| 2006/0169843 | A1 | 8/2006 | Barrs et al. | |
| 2008/0067291 | A1 | 3/2008 | Logosz et al. | |

FOREIGN PATENT DOCUMENTS

| | | |
|---|---|---|
| DE | 33 05 291 A1 | 8/1983 |
| DE | 20 2010 007 197 U1 | 8/2010 |
| FR | 2 762 583 A1 | 10/1998 |
| FR | 2 854 608 A1 | 11/2004 |
| WO | WO 82/00448 A1 | 2/1982 |
| WO | WO 2011/085921 A1 | 7/2011 |

OTHER PUBLICATIONS

European Patent Office; Extended European Search Report in European Patent Application No. 12 169 596.9 (May 13, 2013).

* cited by examiner

*Primary Examiner* — Brian M O'Hara
*Assistant Examiner* — Keith L Dixon
(74) *Attorney, Agent, or Firm* — Leydig, Voit & Mayer, Ltd.

(57) ABSTRACT

A device for coupling a pair of kite lines to a kite harness loop has a first releasable coupling rotatably attached to the harness loop for securing a first kite line to the harness loop and a second releasable coupling rotatably attached to the harness loop for securing a second kite line to the harness loop. The first and second couplings are rotatable about a common axis. An attachment point for a third line is provided. The attachment point is also rotatable about the common axis.

19 Claims, 7 Drawing Sheets

DEVICE FOR COUPLING OF KITE LINES

TECHNICAL FIELD

The present invention relates to traction kites and in particular to a device for coupling a kite line in a kite control system.

BACKGROUND OF THE INVENTION

The popularity of kite surfing has increased dramatically over the last 10 years. Much of the growth in popularity can be associated with significant improvements in kite design, kite control systems and safety systems to make kite surfing easier and safer for the general public. There remains a general need and desire to continue to improve kite control systems and safety systems to further increase popularity and safety in the sport.

A kite surfer is attached to a kite by a plurality of lines, which make up the kite control system. There are lines for piloting or controlling the kite, a traction line for transferring traction forces from the kite to the rider to propel the rider, lines to assist the rider in re-launching the kite from water and a leash to generally tether a rider to a non-flying or depowered kite so that the kite is not carried away and lost. All of these lines must somehow be attached to or controlled by the rider.

One problem that exists is that kite lines become twisted when performing tricks and jumps. Accordingly there exists a need for a device for coupling kite lines that ameliorates twisting of lines or that at least provides a way for a rider to more easily remove twists in kite lines.

DISCLOSURE OF THE INVENTION

To this effect, according to one aspect of the invention there is provided a device for coupling a pair of kite lines to a kite harness loop, the device comprising a first releasable coupling rotatably attached to the harness loop for securing a first kite line to the harness loop and a second releasable coupling rotatably attached to the harness loop for securing a second kite line to the harness loop, the first and second couplings being rotatable about a common axis.

Preferably, the first and second couplings are independently releasable first and second latches.

Preferably, first latch has a handle movable in a first direction away from the loop for releasing the first coupling, and a second handle moveable in a second direction, opposite to the first direction, for releasing the second coupling.

Preferably, the first handle blocks the second coupling such that the first coupling must be released before the second coupling can be released.

Preferably, the first handle is movable axially on the common axis in the first direction and the second handle is movable axially on the common axis in the second direction.

Preferably, the first and second couplings are provided on a coupling body rotatably attached to the harness loop.

Preferably, the first or second coupling is a pelican-type hook for securing a kite line and which opens up with a pull or push of a release handle.

Preferably, the first kite line is a kite depower line and the second kite line is a kite landing line.

Preferably, the device further includes an attachment point for a third line, the attachment point being rotatable about the common axis.

Preferably, the attachment point comprises an attachment member rotatably located between the coupling body that is rotatably attached to the harness loop.

Preferably, the attachment point is provided for attaching a kite control system to a harness via a leash.

Preferably, the device is in combination with a kite harness loop.

Preferably, the device is in combination with a kite control system including a harness loop and control bar and a plurality of kite lines.

According to another aspect of the invention there is also provided a kite attachment system comprising a harness loop, a releasable coupling for releasably attaching the harness loop to a traction line of a kite and a leash attachment, the leash attachment and releasable coupling being rotatable with the harness loop about a common axis.

Preferably, the releasable coupling comprises a first releasable coupling rotatably attached to the harness loop for securing a first kite line to the harness loop and a second releasable coupling that is rotatably attached to the harness loop for securing a second kite line to the harness loop, the first and second couplings being rotatable about a common axis.

According to yet another aspect of the invention there is provided a kite attachment system comprising a kite harness loop defining a longitudinal axis between a rider and a kite, and a leash attachment point for a kite leash that secures a kite to a rider's harness, wherein the leash attachment point is rotatably located with the harness loop and is rotatable about the longitudinal axis.

Yet further aspects of the invention are defined in the claims, or will be apparent from the following description and appended drawings.

BRIEF DESCRIPTION OF THE DRAWINGS

Preferred forms of the present invention will now be described by way of example only with reference to the accompanying drawings, wherein.

DESCRIPTION OF THE PREFERRED EMBODIMENTS

The following description is given by way of example only to illustrate the invention and is not intended to limit the scope of use or functionality of the invention. In particular, the invention is not limited in its application to the details of construction and the arrangements of components set forth in the following description or illustrated in the accompanying drawings. The invention is capable of other embodiments and of being practiced or being carried out in various ways. Also, it is to be understood that the phraseology and terminology used is for the purpose of description and should not be regarded as limiting.

Figure 1:
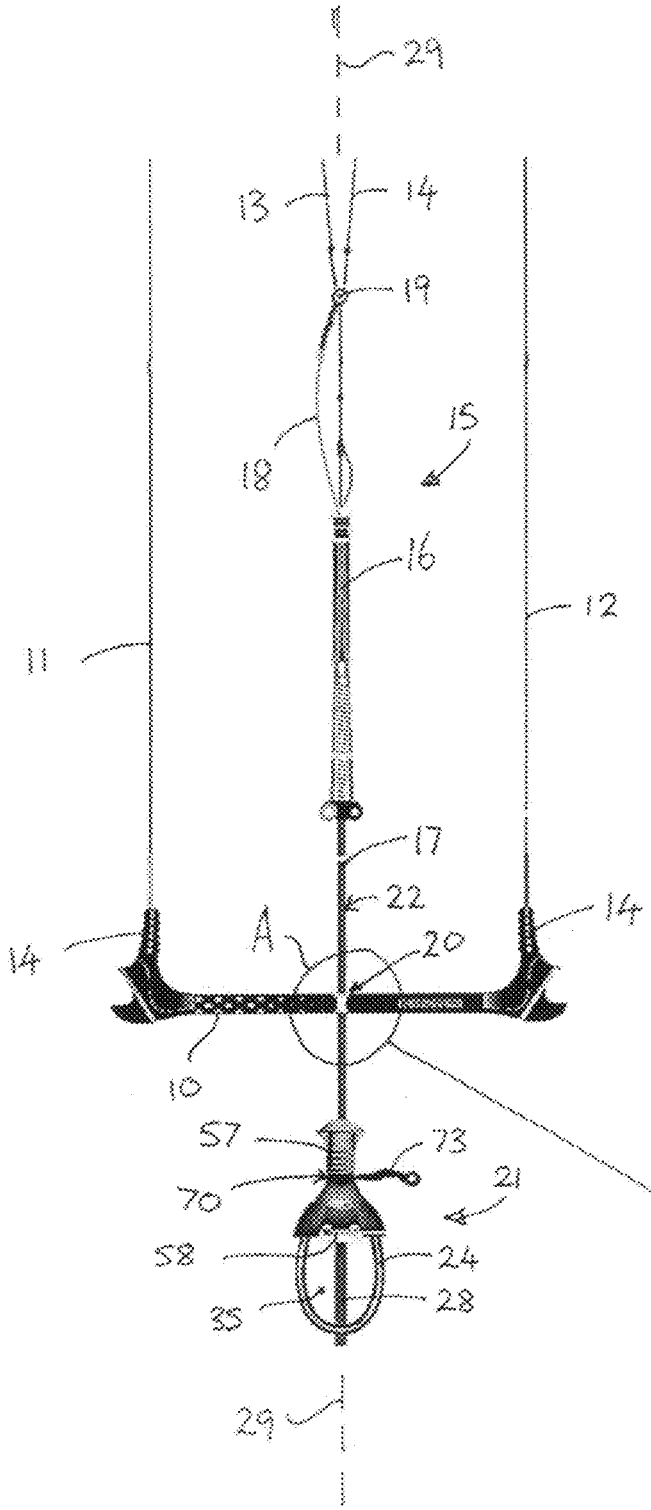
FIG. 1 is partial illustration of a kite control system.
Figure 2:
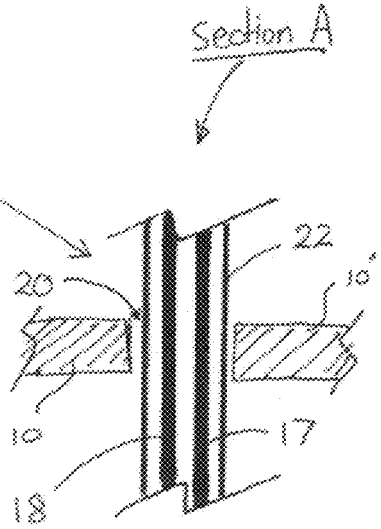
FIG. 2 is a section illustration of features marked 'A' in FIG. 1.
Figure 3:
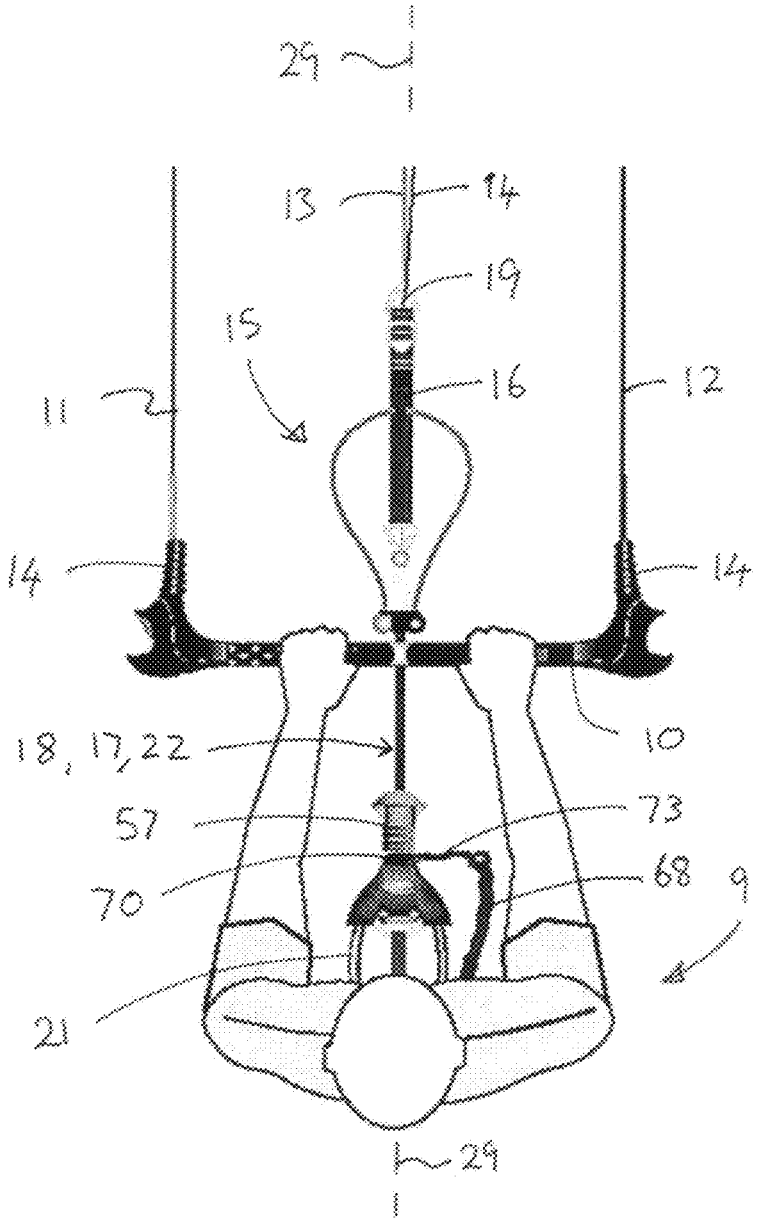
FIG. 3 is an illustration of a rider interacting with the kite control system.

Referring to drawings, and in particular FIGS. 1-3, a control system for a traction wing (or kite) generally includes a pair of rear kite lines 11, 12, and a pair of front control lines 13, 14. The rear control lines 11, 12, connect to fittings 14 at the ends of a control bar 10, which is held and manipulated by a rider or kite surfer 9. The front lines 13, 14 join at a point 19 located between the rider 9 and the kite. A traction line assembly 15 extends from the connection point 19 of the front lines to a harness loop 21, which attaches to a harness worn by the rider 9. Traction forces from the kite are transferred to the rider by the traction line assembly 15, causing the rider to be propelled by the kite. The traction line assembly 15 typically comprises two portions, namely a trim strap 16 used to adjust the length of the traction line for "trimming" the flying attitude of the kite, and a depower portion 17 between the trim strap 16 and harness loop 21. Together the trim strap 16 and depower line 17 are part of the traction line assembly 15. The depower line 17 passes through an aperture 20 in the central region of the control bar 10. The rider 9 can manipulate the control bar along the depower line 17 between the harness loop 21 and trim strap 16 to alter the relative lengths of the front and rear lines, thereby controlling the power of the kite.

Also extending from the front line connection point 19 to the harness loop 21 is a landing line 18. The landing line 18 is longer than the traction line 16 and, under normal riding conditions, does not take any traction force of the kite. The landing line 18 also passes through the aperture 20 in the control bar 10. The landing line 18 and the depower line 17 pass through and are surrounded by a flexible sleeve or tube 22 extending through the aperture 20 in the control bar 10. FIG. 2 shoes a cross section of area A of FIG. 1 illustrating the relative arrangement of the bar 10, sleeve 22 and lines 17, 18. The control bar 10 slides along the sleeve 22 when manipulated by the rider 9 to power and depower the kite. The depower line 17 and landing lines 18 releasably attach to the harness loop 21 via two independently releasable couplings. The couplings have co-linear rotational axes and are rotationally fixed such that the control bar 10 and/or lines can be rotated together to avoid or ameliorate twisting of the lines.

Referring now to FIGS. 4 through 8 in particular, the harness loop 21 for attaching to a harness worn by rider 9 has a harness loop body 33 with a pair of diverging arms 25, 26, and a semi flexible tube 24 attached at either end to respective ones of the arms 25, 26, to form the loop 35. The harness loop body 33 and loop 35 define a centre line 29 that is coincident with a centre line of the kite traction line assembly 15. A brace 27 is provided between the arms 25, 26, to partially segment the loop 35. A security pin 28 is attached to the brace 27 and extends past the back edge of the loop. The security pin 28 engages with the harness hook (not shown) to prevent the loop 35 from unintentionally unhooking from the hook.

Figure 9:
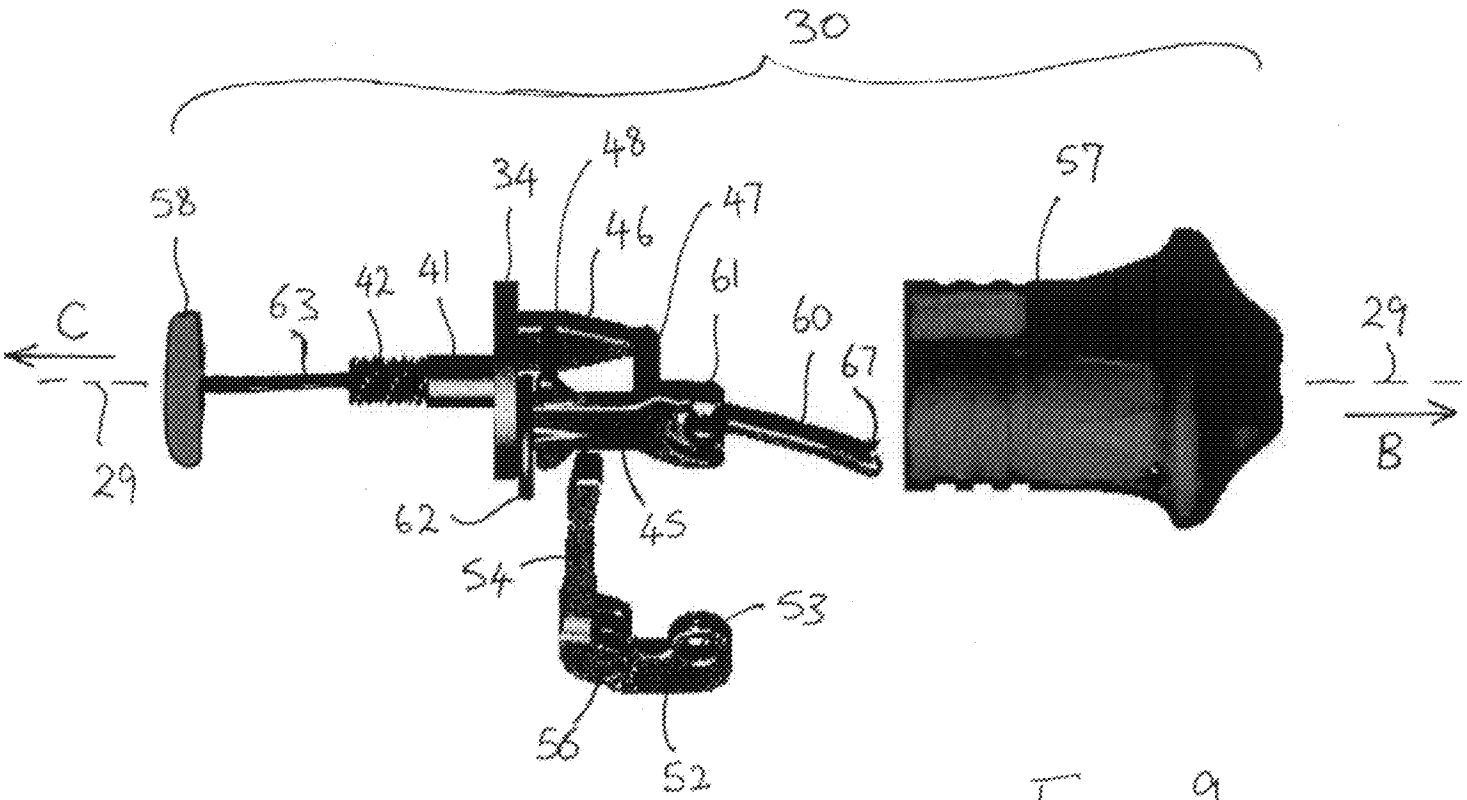
FIG. 9 is an exploded illustration of the independently releasable line couplings and a leash coupling.

A release mechanism 30, shown in FIG. 9, is located at the front part of the harness loop body 33 opposite the loop and includes the two independently releasable couplings for attaching the depower line 17 and landing line 18 to the harness loop 21. The release mechanism is provided with two release handles 57, 58 that can be manipulated by the rider for operating the couplings to release the depower line 17 and landing line 18 from its respective coupling. A first one of the handles is a depower line release handle 57 that forms an outer body of the release mechanism 30. The depower line release handle 57 is a push release handle that is grasped by the rider and pushed away from the rider towards the kite in a direction 'B' along the centre line 29 to release the depower line coupling. The second handle is a landing line release handle 58 located concentrically with the depower line release handle 57 on the opposite side of the harness loop body 33 within the loop 35. The landing line release handle 58 is a pull release handle that is grasped by the rider and pulled towards from the rider and away from the kite in an opposite direction 'C' along the centre line 29 to release the landing line coupling.

The harness loop body 33 has a passage 36 through the body, along its longitudinal centre line 29, which is coincident with the traction line assembly 15 of the kite. The passage 36 extends from the top of the body 33 through the body to within the loop 35. The harness loop body 33 also has an opening 37 passing through the body 33 in a direction transverse to the passage 36 and which intersects with the passage 36. An inner body 40 of the release mechanism 30 comprises a release plate 34 with a shaft 41 having an external diameter that is marginally smaller than the internal diameter of the loop body passage 36 and is inserted within passage 36. A tip end 42 of the shaft 41 is threaded for engagement by a nut 43 (FIG. 4) that is located within the aperture 37 through the harness body 33. Engagement of nut 43 with shaft 41 secures the release inner body 40 to the harness loop body 33 while allowing the release body 40 to freely rotate with respect to the loop body 33 and loop 35. A passage 50 through the release body 40 communicates with passage 36 in the loop body 33 to provide a single passage 36, 50, through both the release body 40 and loop body 33.

Figure 5:
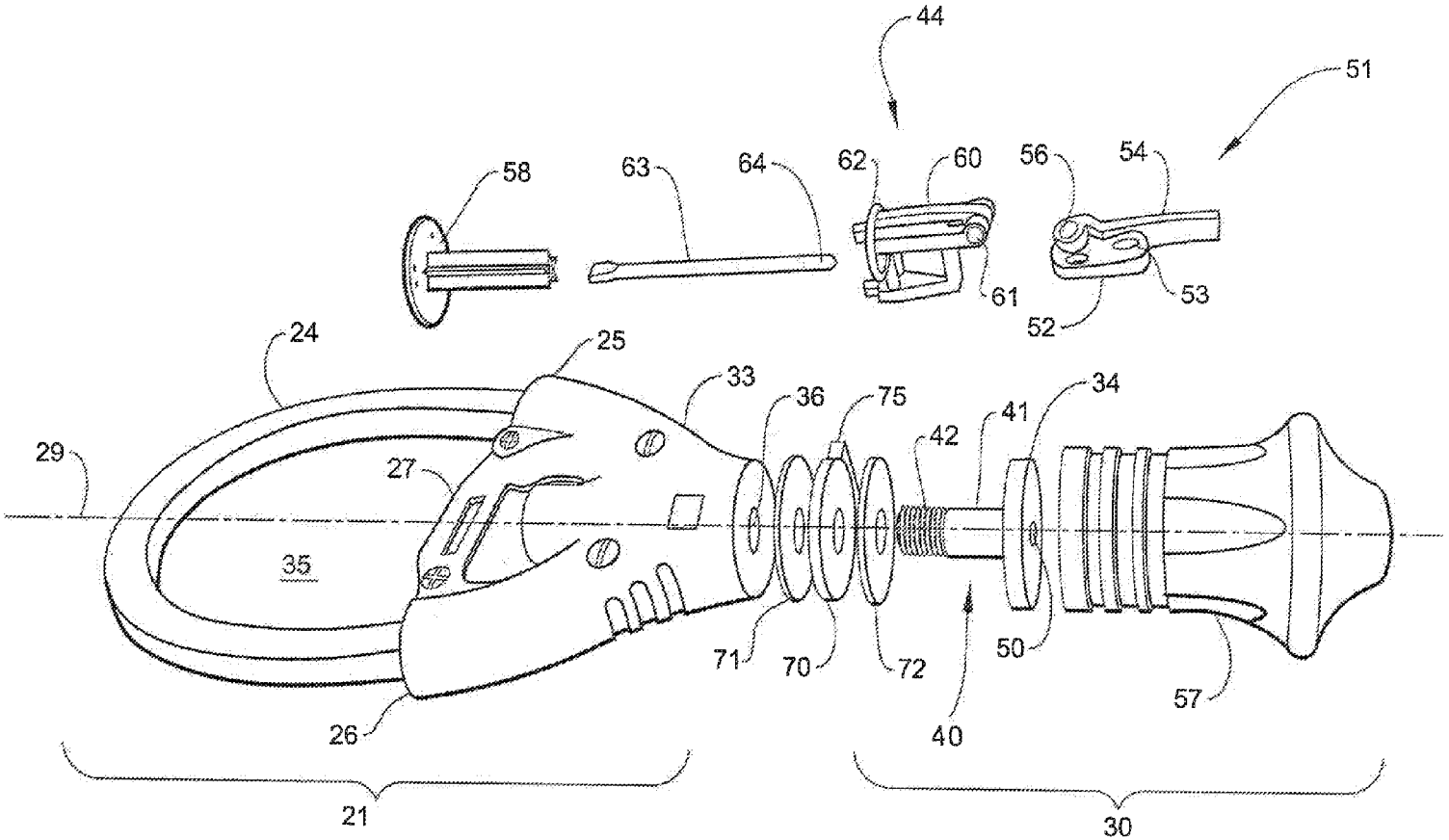
FIG. 5 is an exploded illustration of the kite harness loop in combination with the independently releasable line couplings and a leash coupling.
Figure 6:
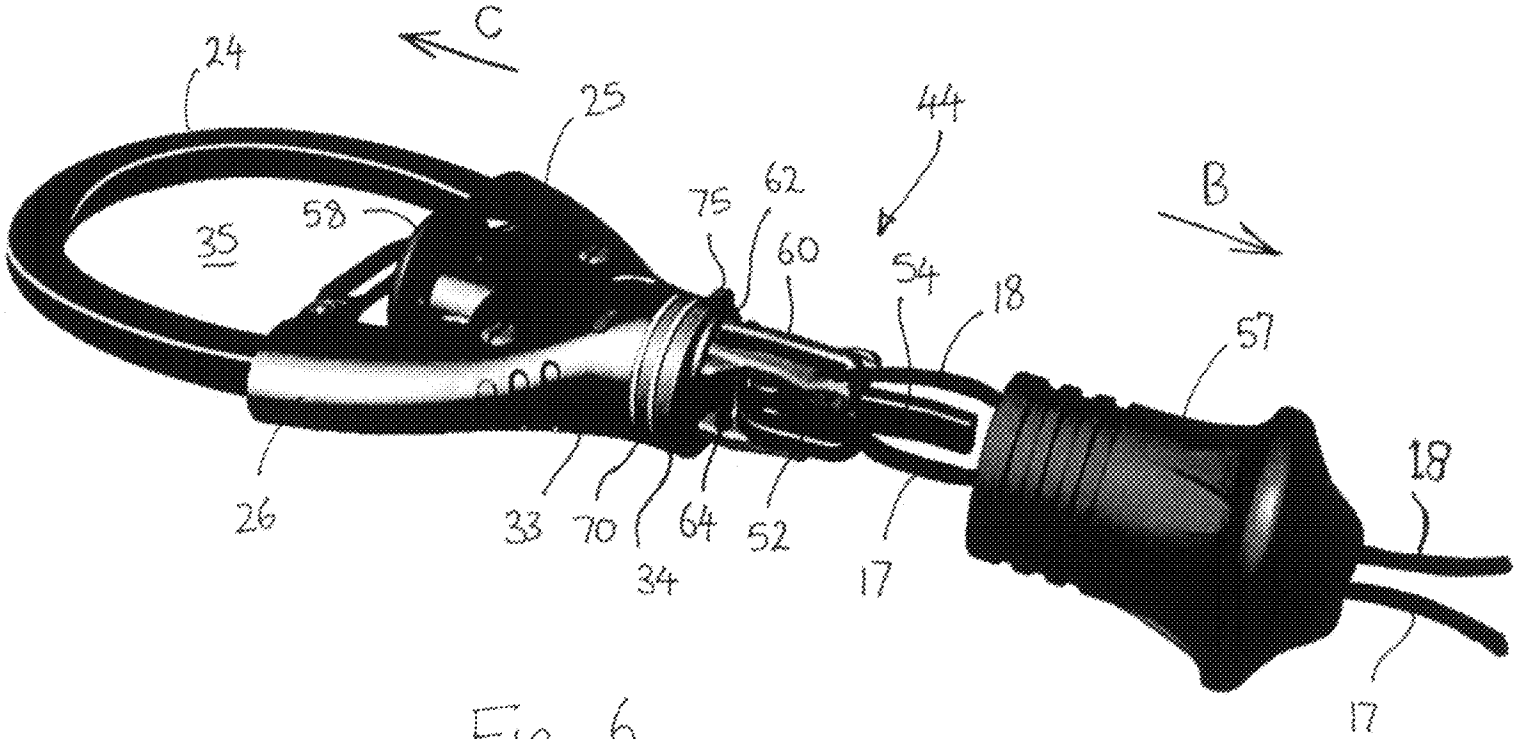
FIG. 6 is a perspective illustration of the kite harness loop in combination with the independently releasable line couplings and a leash coupling.
Figure 7:
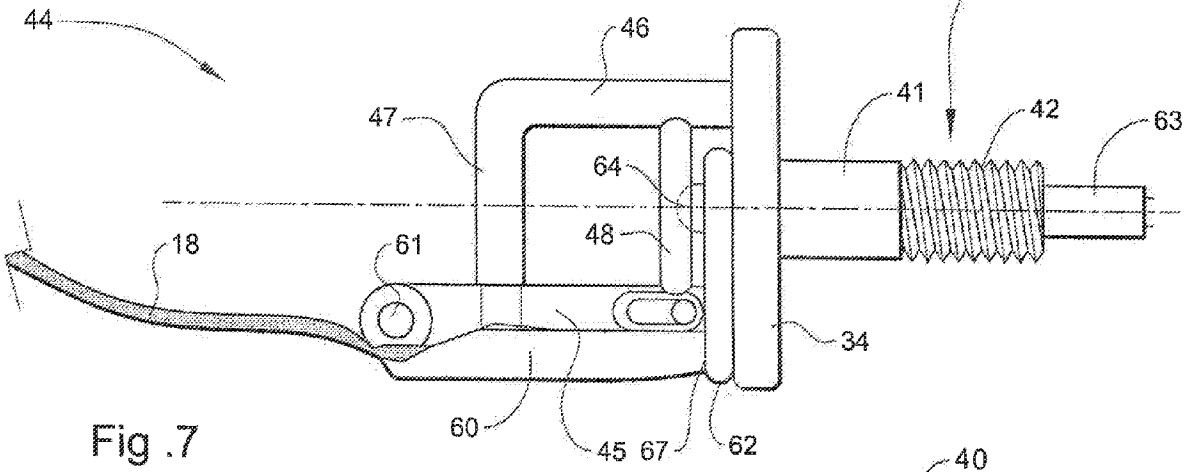
FIG. 7 is an illustration a release mechanism in a closed condition.
Figure 8:
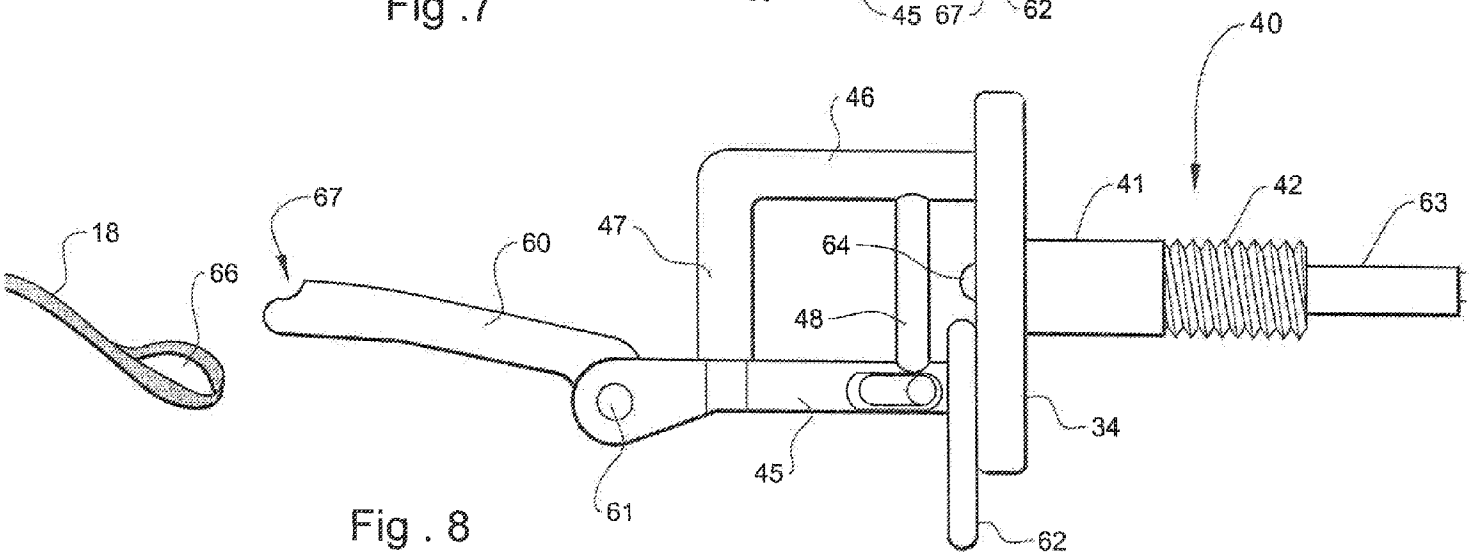
FIG. 8 is an illustration a release mechanism in an open condition.

The release mechanism 30 also includes a release fitting 44 secured to the release plate 34 on an opposite side to shaft 41. The fitting comprises a pair of side arms 45, 46, located on opposite sides of aperture 50 in the inner release body 40. A pair of link bars link the side arms 45, 46. A first top bar 47 is located between top ends of the arms 45, 46, and an intermediary bar 48 is located slightly spaced from the release plate 34. The side arms 45, 46, and the first top bar 47 provide an eyelet for securing of a first latching pin 51 (FIG. 5). The latching pin 51 comprises a C-shaped pin plate 52 having an aperture 53 at a first end for attachment of the depower line and a tongue 54 pivotally connected at a second end by a hinge pin 56. The tongue 54 and pin plate 52 are freely pivotable with respect to each other such that the tongue can be pivoted to lie in line with the pin plate 52 or can fold back against the pin plate 52. The C-shaped pin plate 52 has a narrow waist such that when tongue 54 is folded back along the pin plate 52, it forms a small loop. For attachment of the depower line 17 to the harness loop 21, the depower line 17 is attached to the aperture 53 of the release pin 51 and tongue 54 passed through the eyelet of the release structure 44 and folded back on pin plate 52, securing the release pin 51 about the upper linking bar 47 of the release fitting 44 in the form of a pelican hook. The depower line release handle 57, which forms the outer body of the release mechanism, is hollow and locates over the release fitting 44 for retaining the tongue 54 of the first latching pin 51 in the closed condition. The depower line is secured to the harness loop 21. The release fitting 44, release pin 51 and release handle 57 together form the first of the releasable couplings. When the release handle 57 is pushed away from the rider towards the kite, in a direction along the centre line 29, the handle moves clear of the release fitting thereby freeing the tongue 54, which is free to pivot to allow the release pin 51 to uncouple from the release fitting 44, thus uncoupling the depower line 17 from the harness loop 21.

One of the pair of side arms 45, 46, of releasing fitting 44 is longer than the other and extends beyond the upper linking bar 47. A second tongue 60 is connected to the distal end of the longer side arm 45 by a second hinge pin 61. The second tongue 60 can pivot back, along the arm 45, in the form of a second pelican hook for securing a loop 66 in the end of the landing line 18 to the release fitting. The second tongue 60 is substantially the same length as arm 45 and its second end, opposite the hinge end 61, has a contoured surface 67 for engaging the edge of a locking ring 62. The locking ring 62 is located around the longer arm 45 and passes in a space between the intermediary bar 48, between the arms and the release plate 34. A pin 63 is located in the passage 36, 50, of the loop body 33 and release body 40. The distal end 64 of the pin projects from the passage above the release plate 34 where it is engageable by the locking ring 62. The pin 63 holds the locking ring 62 in a locking position, retaining the second tongue 60 in a closed position. The landing line release handle 58 is attached to the second end 65 of the pin 63. When a rider 9 pulls the landing line release handle towards the rider and away from the kite in a direction along the centre line 29, the first end 64 of the pin 63 is retracted into the passage 36, 50, and disengages from locking ring 62. The locking ring 62 moves to free the end of second tongue 60, allowing the tongue to pivot and release the landing line 18. The second tongue 60, locking ring 62, pin 63 and release handle 58 together form the second of the releasable couplings. As both of the releasable couplings for the depower line and the landing line are located at the release fitting 44, they rotate together with the release body about centre line 29.

Figure 4:
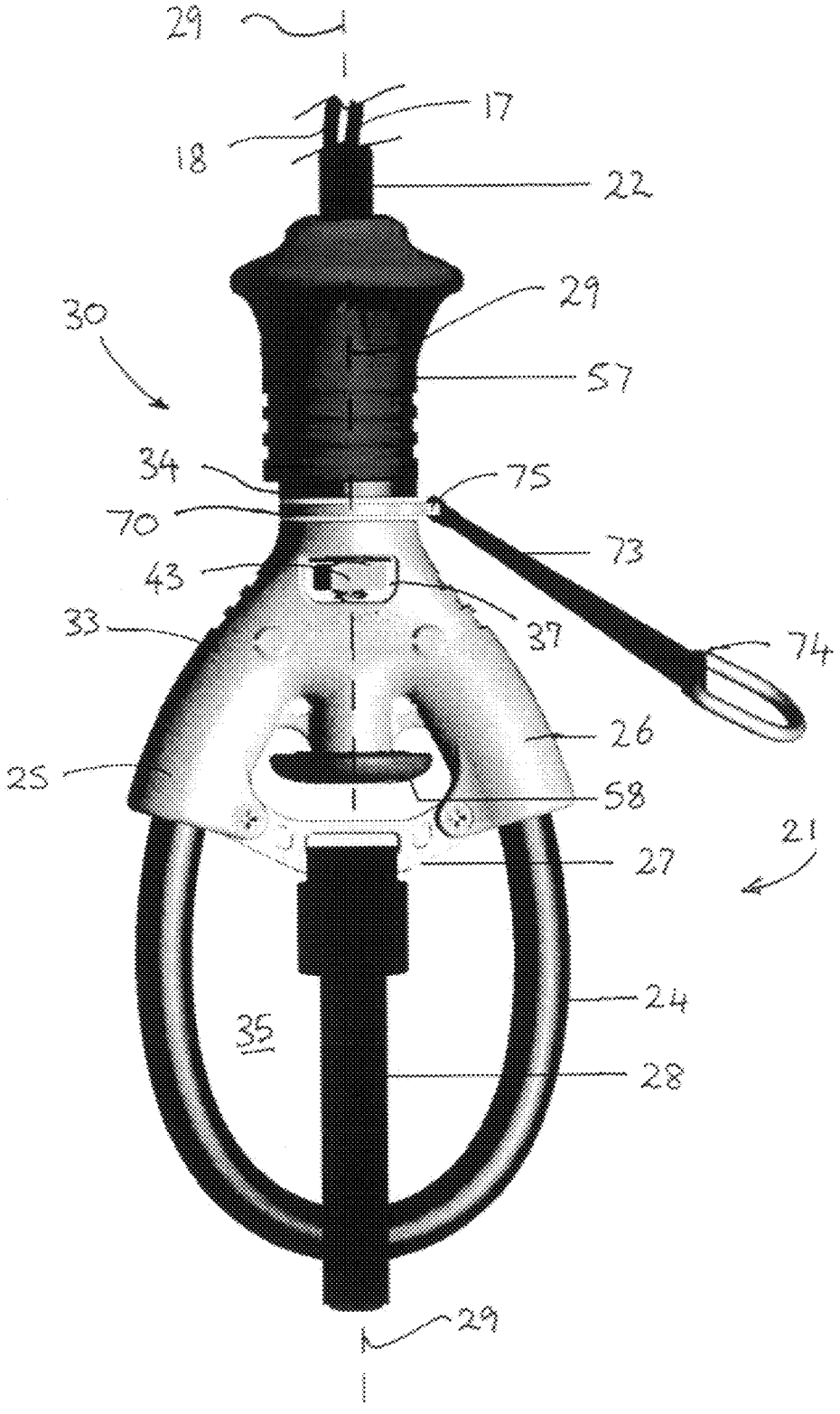
FIG. 4 is an illustration of a kite harness loop in combination with independently releasable line couplings and a leash coupling.

In the release mechanism of the preferred embodiment the second release coupling for the landing line 18 cannot be activated until the first release for the depower line 17 has been activated. In the coupled configuration, such as shown in FIG. 4, the release handle 57 also blocks the second tongue 60 of the second release coupling. If the second release handle 58 is operated before the first coupling is released, the pin 63 will release the ring 62, but the second tongue 60 continues to be blocked by first release handle 57. Thus, the arrangement of the preferred embodiment also controls the order of release of the line couplings. The first coupling for the depower line 17 must be operated before the second coupling for the landing line 18 can be operated.

In addition to the two independently releasable couplings for the depower and landing lines 17, 18, the preferred embodiment of the invention has a leash attachment 70, 73, 74, rotatable about the rotational centre line 29 for attachment of a kite retaining leash 68 (FIG. 3). A leash attachment washer 70 is located on release fitting shaft 41 between the release body 44 and loop body 33. Low friction washers 71, 72 are preferably provided on opposite sides of leash attachment washer 70 to ameliorate any binding between the leash attachment washer 70 and release body 44 and/or loop body 36. The low friction washers 71, 72 are preferably made of or coated in a low friction material such as polytetrafluoroethylene (PTFE), which is commonly known by the brand name TEFLON. To aid in easy attachment of the leash, the leash attachment washer 70 is provided with an attachment tab 75 to which a short length of webbing 73 and D-ring 74 are attached. Because the leash attachment is freely rotatably with respect to the control bar 10 and harness loop 21 about co-linear rotational axis 29, twisting of the leash is ameliorated when the harness loop 21 or the control bar 10 is rotated to untwist the front and rear lines 11, 12, 13, 14, after a trick or turn.

The invention claimed is:

1. A release device releasably coupling a traction line assembly of a kite, the traction line assembly having a center line and including a depower line and a front line connection point, lying along the center line, to a kite harness, wherein the kite harness has a harness body including a longitudinal passage having a longitudinal axis coincident with the center line of the traction line assembly and through which the depower line and the landing line pass and are releasably connected to the harness body, the release device comprising:

a first releasable coupling rotatably attached to the harness body, wherein the first releasable coupling has a closed position clamping an end of the depower line and, thereby, connecting the depower line to the harness body, and an open position releasing the end of the depower line so that the depower line is not connected to the harness body; and a second releasable coupling rotatably attached to the harness body, wherein the second releasable coupling has a closed position clamping an end of the landing line and, thereby, connecting the landing line to the harness body, and an open position releasing the end of the landing line so that the landing line is not connected to the harness body, and wherein the first and second releasable couplings are commonly rotatable about the longitudinal axis of the harness body, which longitudinal axis is coincident with the center line of the traction line assembly.

2. The release device of claim 1, wherein the first and second releasable couplings are independently releasable.

3. The release device of claim 1, wherein the first releasable coupling has a first handle movable in a first direction, away from the kite harness loop, for transitioning the first releasable coupling from the closed position to the open position, and the second releasable coupling has a second handle moveable in a second direction, opposite from the first direction, for transitioning the second releasable coupling from the closed position to the open position.

4. The release device of claim 3, wherein, when the first releasable coupling is in the closed position, the first handle blocks the second releasable coupling from releasing the end of the landing line so that the first releasable coupling must transition to the open position before the second releasable coupling can transition from the closed position to the open position.

5. The release device of claim 3, wherein the first and second directions lie on the longitudinal axis of the harness body, which longitudinal axis is coincident with the center line of the traction line assembly.

6. The release device of claim 1 including a coupling body adjoining the harness body, wherein the first and second releasable couplings are located at least partially in the coupling body.

7. The release device of claim 1, wherein one of the first and second releasable couplings includes a pelican hook for securing the end of one of the depower and landing lines, and the pelican hook opens in response to one of pushing and pulling of a release handle.

8. The release device of claim 1 further including an attachment member for attaching a kite retaining leash to the harness body, wherein the attachment member is rotatable about the longitudinal axis of the harness loop body, which longitudinal axis is coincident with the center line of the traction line assembly.

9. The release device of claim 3 further including an attachment member for attaching a kite retaining leash to the harness body, wherein the attachment member is rotatable about the longitudinal axis of the harness loop body, which is coincident with the center line of the traction line assembly, and the attachment member is disposed between the first and second handles.

10. The release device of claim 8 including a leash attached to the attachment member and to the kite for retrieving the kite when the ends of the depower and landing lines are released from the first and second releasable couplings.

11. A kite control system comprising:

a depower kite line and a landing kite line commonly lying on a center line of a traction line assembly of a kite, wherein the traction line assembly includes the depower line, the landing line, and a front line connection point, a kite harness including a harness body, wherein the harness body includes a longitudinal passage having a longitudinal axis coincident with the center line of the traction line assembly and through which the depower kite line and the landing kite line pass and are releasably connected to the kite harness, a control bar, and a device for releasably coupling the depower kite line and the landing kite line to the kite harness, wherein the device for releasably coupling comprises a first releasable coupling rotatably attached to the harness body, wherein the first releasable coupling has a closed position clamping an end of the depower line and, thereby, connecting the depower line to the harness body, and an open position releasing the end of the depower line so that the depower line is not connected to the harness body, and a second releasable coupling rotatably attached to the harness body, wherein the second releasable coupling has a closed position clamping an end of the landing line and, thereby, connecting the landing line to the harness body, and an open position releasing the end of the landing line so that the landing line is not connected to the harness body, and wherein the first and second releasable couplings are commonly rotatable about the longitudinal axis of the harness body, which longitudinal axis is coincident with the center line of the traction line assembly.

12. The kite control system of claim 11, wherein the first releasable coupling has a first handle movable in a first direction, away from the kite harness loop, for transitioning the first releasable coupling from the closed position to the open position, and the second releasable coupling has a second handle moveable in a second direction, opposite from the first direction, for transitioning the second releasable coupling from the closed position to the open position.

13. The kite control system of claim 12, wherein, when the first releasable coupling is in the closed position, the first handle blocks the second releasable coupling from releasing the end of the landing line so that the first releasable coupling must transition to the open position before the second releasable coupling can transition from the closed position to the open position.

14. The kite control system of claim 12, wherein the first and second directions lie on the longitudinal axis of the harness body which is coincident with the center line of the traction line assembly.

15. The kite control system of claim 11 including a coupling body adjoining the harness body, wherein the first and second releasable couplings are located at least partially in the coupling body.

16. The kite control system of claim 11 further including an attachment member for attaching a kite retaining leash to the harness body, wherein the attachment member is rotatable about the longitudinal axis of the harness loop body, which longitudinal axis is coincident with the center line of the traction line assembly.

17. The kite control system of claim 16 further including an attachment member for attaching a kite retaining leash to the harness body, wherein the attachment member is rotatable about the longitudinal axis of the harness loop body, and the attachment member is disposed between the first and second handles.

18. The kite control system of claim 16 including a leash attached to the attachment member and to the kite for retrieving the kite when the ends of the depower and landing lines are released from the first and second releasable couplings.

19. The kite control system of claim 11 further comprising first and second rear kite lines, wherein the control bar has two opposed ends and a central passage, the depower line and the landing line slidingly pass through the central passage of the control bar, and the first and second rear kite lines are connected to respective ends of the control bar.

* * * * *